United States Patent [19]

Bailey

[11] Patent Number: 4,919,332

[45] Date of Patent: Apr. 24, 1990

[54] RISER OR POP-UP IRRIGATION SPRINKLER

[75] Inventor: James L. Bailey, P.O. Box 119, Collaroy Beach, NSW 2097, Australia

[73] Assignee: James L. Bailey, Collaroy Beach, Australia

[21] Appl. No.: 162,735

[22] Filed: Mar. 1, 1988

[30] Foreign Application Priority Data

Mar. 2, 1987 [AU] Australia ..... 69837

[51] Int. Cl.[5] ..... B05B 15/10

[52] U.S. Cl. ..... 239/205; 239/600

[58] Field of Search ..... 239/204, 205, 288, 288.5, 239/600

[56] References Cited

U.S. PATENT DOCUMENTS

| | | | |
|---|---|---|---|
| 2,585,782 | 2/1952 | Johnson | 239/205 |
| 2,901,183 | 8/1959 | Kohl | 239/205 |
| 3,282,508 | 11/1966 | Roberts | 239/204 |
| 4,145,003 | 3/1979 | Harrison et al. | 239/204 |
| 4,316,579 | 2/1982 | Ray et al. | 239/205 |

FOREIGN PATENT DOCUMENTS

| | | | |
|---|---|---|---|
| 101241 | 4/1937 | Australia | 239/205 |

*Primary Examiner*—Andres Kashnikow
*Assistant Examiner*—Michael J. Forman
*Attorney, Agent, or Firm*—Harness, Dickey & Pierce

[57] ABSTRACT

A diaphragm type riser for an irrigation sprinkler including a coil compression spring that acts against the diaphragm for urging the riser to its retracted position.

2 Claims, 3 Drawing Sheets

RISER OR POP-UP IRRIGATION SPRINKLER

BACKGROUND OF THE INVENTION

The present invention relates to an improved riser for an irrigation sprinkler system and, in particular, to a retractable sprinkler wherein, said riser is biased in a normally retracted position, and, upon the introduction of fluid, said riser rises to consequently dissipate said fluid.

Prior art irrigation sprinklers embody a wide variety of different functional mechanisms. There are two major sprinkler systems of the inground type which include a housing which is buried just below ground surface, wherein a riser is biased in a normally retracted position such that upon the introduction of fluid, the riser rises to an elevated sprinkling position.

One type of known inground irrigation sprinkler system comprises sliding fluid riser tubes. Generally this type of sprinkler system does not allow good extension between a retracted position and an elevated position. Consequently, the sprinkler does not produce good water distribution. Further, the sprinkler riser tends to stick within the sliding riser guide, due to grass, soil or other material, which is added to the soil in granular form for the purposes of fertilizing insect or weed control, becoming lodged within the housing. These prior art sprinklers therefor require continual and extensive maintenance in removing this matter from the sliding parts of said riser guides.

In order to overcome the disadvantages of the aforementioned type of inground irrigation sprinkler systems, it has also been previously proposed to provide a flexible diaphragm suspended between the housing wall and the riser tube. Such a diaphragm serves the dual purpose of providing a seal between the housing wall and the riser tube such that foreign matter is prevented from entering the sprinkler, and, also acts to provide the support for the riser and its movement between the retracted and the elevated sprinkling position. These diaphragm type arrangements do offer some advantages, however, the prior art sprinkler systems utilizing this type of mechanism all have a number of shortcomings.

In order to provide a diaphragm-type sprinkler arrangement which allows sufficient movement and also ensures automatic retraction of the riser upon impedance of the fluid flow, it was proposed to employ springs, which would retract the riser whilst not in use. A number of various embodiments of diaphragm-spring arrangements have been proposed utilizing tension-spring arrangements, however, due to the design of such risers, it has not been possible to produce a compact sprinkler unit. A tension spring cannot extend elastically to more than roughly twice its relaxed length. Therefore, in order to provide good extension of the riser, a spring of considerable length is necessary. However, longer springs result in a less compact sprinkler unit. Therefore, the tension springs employed must be selected such that they have sufficient force to effect and maintain retraction, and such that they do not restrict the movement of the riser from reaching a good extended position. In order to effect a good sprinkler-unit design, it has therefore been necessary to compromise between large vertical extension and diaphragm positioning.

The vertical movement of the diaphragm arrangement can be minimized if the diaphragm is attached to the housing at a level corresponding with the base of the sprinkler head. The disadvantage of this arrangement is that debris can collect in the space provided for it which will inevitably lead to interference with the operation of the sprinkler head.

If the diaphragm is attached as closely as possible to the top of the housing, then the vertical distance that the sprinkler head travels is necessarily a function of the need for retracted containment of the sprinkler head and the depth of the conical shaped diaphragm.

U.S. Pat. No. 2,901,183 in the name of G. C. KOHL, discloses a typical diaphragm-spring arrangement displaying many of the above-mentioned shortcomings. Kohl's sprinkler comprises a housing provided with a diaphragm at the top thereof. The sprinkler head is provided in the center of the diaphragm, and a spring is fixed therebelow to the bottom of the housing. Kohl's sprinkler however has a number of drawbacks. Firstly, due to the construction of the sprinkler, the device is reasonably difficult and expensive to manufacture, and difficult to assemble and install ready for use. According to Kohl's design having a top mounted diaphragm controlled by a tension spring arrangement and incorporating sufficient sprinkler head rise and retraction to accommodate a compact sprinkler, such an implementation would require a housing diameter to length ratio of about 1:4. For example a common golf course pop-up riser with a 20 cm diameter housing would require an 80 cm housing length, which is impractical because of the depth of the hole required to house it, the depth of the piping of the reticulation system and the high frequency of shallow soil depths occurring where sprinkler systems are typically installed. Once assembled, a number of inherent problems become obvious during the functional operation of the sprinkler. The expansion spring arrangement employed by Kohl does not offer sufficient force and direction of force to hold the riser in a vertical position when extended. Since the spring is merely connected to a hook provided underneath the center of the sprinkler head, and due to the turbulance of the water within the chamber, the sprinkler head is unlikely to be maintained in a vertical position, but rather, would tend to wobble and rotate from its correct position. Thus, the fluid would then not dissipate evenly from the sprinkler head. Further, due to this resultant movement on the spring, the spring tends to become twisted, etc., and consequently, fatigue takes place which affects the correct operation of the spring. Eventually, the spring could become distorted and stretched, and may not retract the sprinkler head back into the housing.

The present invention seeks to provide a retractable sprinkler system which overcomes the disadvantages of the herein-above mentioned prior art sprinklers.

The present invention seeks to provide a compact sprinkler which is constructed of minimal parts and which is of compact design.

The present invention seeks to provide a sprinkler system which is provided with a diaphragm, which prevents any foreign matter from reaching the housing of the sprinkler.

The present invention also seeks to provide a sprinkler system in which the riser undergoes smooth movement between the retracted position and the elevated position, which allows large vertical extension, and which retains the sprinkler head in a substantially vertical position during use.

SUMMARY OF THE INVENTION

In one broad form, the present invention provides a retractable sprinkler comprising a housing provided with a fluid inlet at a lower end thereof, a riser, defining a passage therethrough, terminating in a nozzle; a flexible diaphragm sealingly connected between an upper end of said housing and said riser at or near the nozzle, and a compression spring engaged between said housing and said riser. In an inoperative position, the spring maintains said riser within said housing, and, upon the introduction of fluid through said fluid inlet, said riser moves outwards of said housing against the compressive action of said spring, and said fluid consequently flows through said passage and is dissipated from said nozzle.

BRIEF DESCRIPTION OF THE DRAWINGS

The present invention will become more fully understood from the following detailed description of a preferred embodiment thereof in connection with the accompanying drawings, in which.

DETAILED DESCRIPTION OF THE PREFERRED EMBODIMENT OF THE INVENTION

Figure 1:
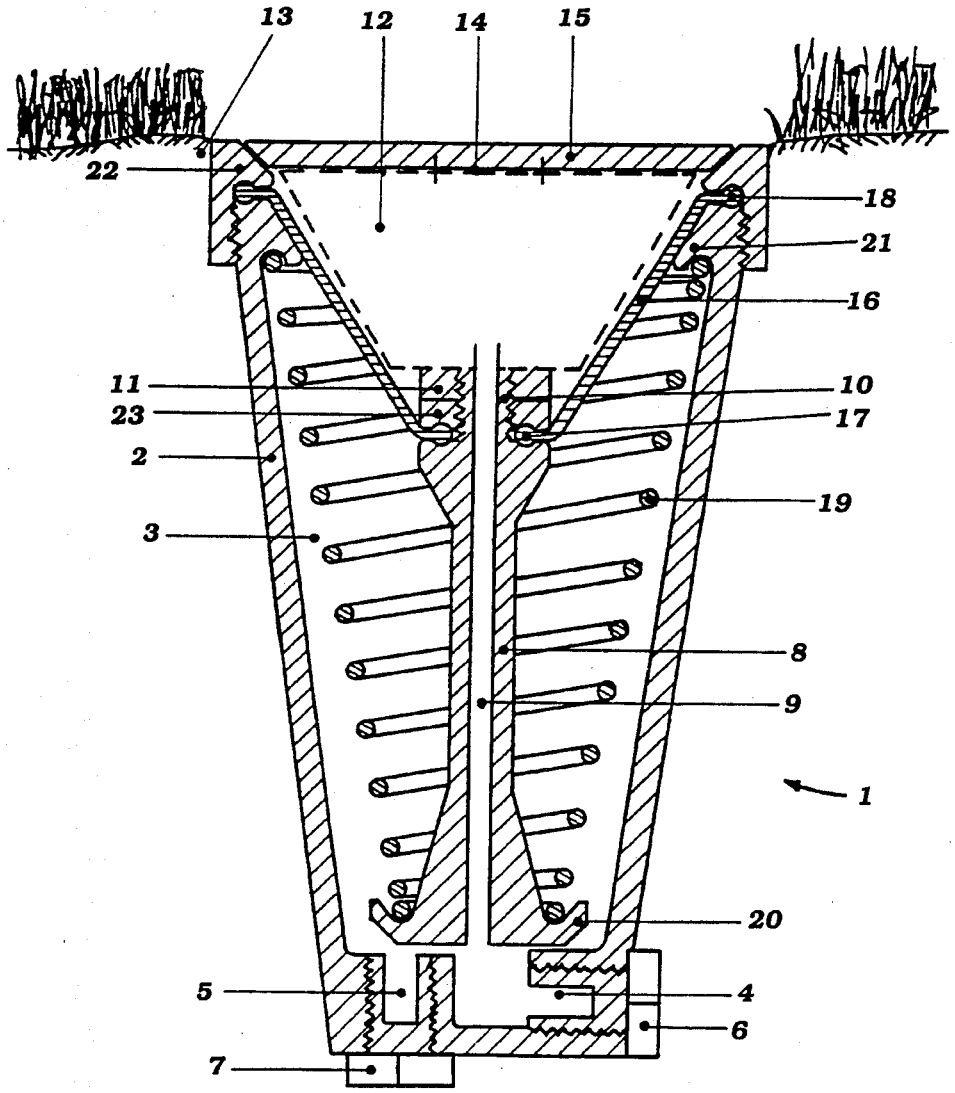
FIG. 1 is a cross-sectional side elevational view of a sprinkler in accordance with the present invention, wherein said sprinkler is in the retracted position.

In FIG. 1, an improved riser for a pop-up irrigation sprinkler in accordance with the present invention, is generally designated by the numeral 1. The irrigation sprinkler 1 includes a housing 2, which is in the shape of the frustum of a cone, defining an internal chamber 3 to which fluid may be admitted through either a selected side fluid inlet 4 or a bottom fluid inlet 5. The fluid inlets 4 and 5 are provided with plugs 6 and 7 respectively. Depending on the particular installation, one of the plugs 6 or 7 is removed, and the water inlet pipe (not shown) is connected to that respective fluid inlet 4 or 5.

Figure 2:
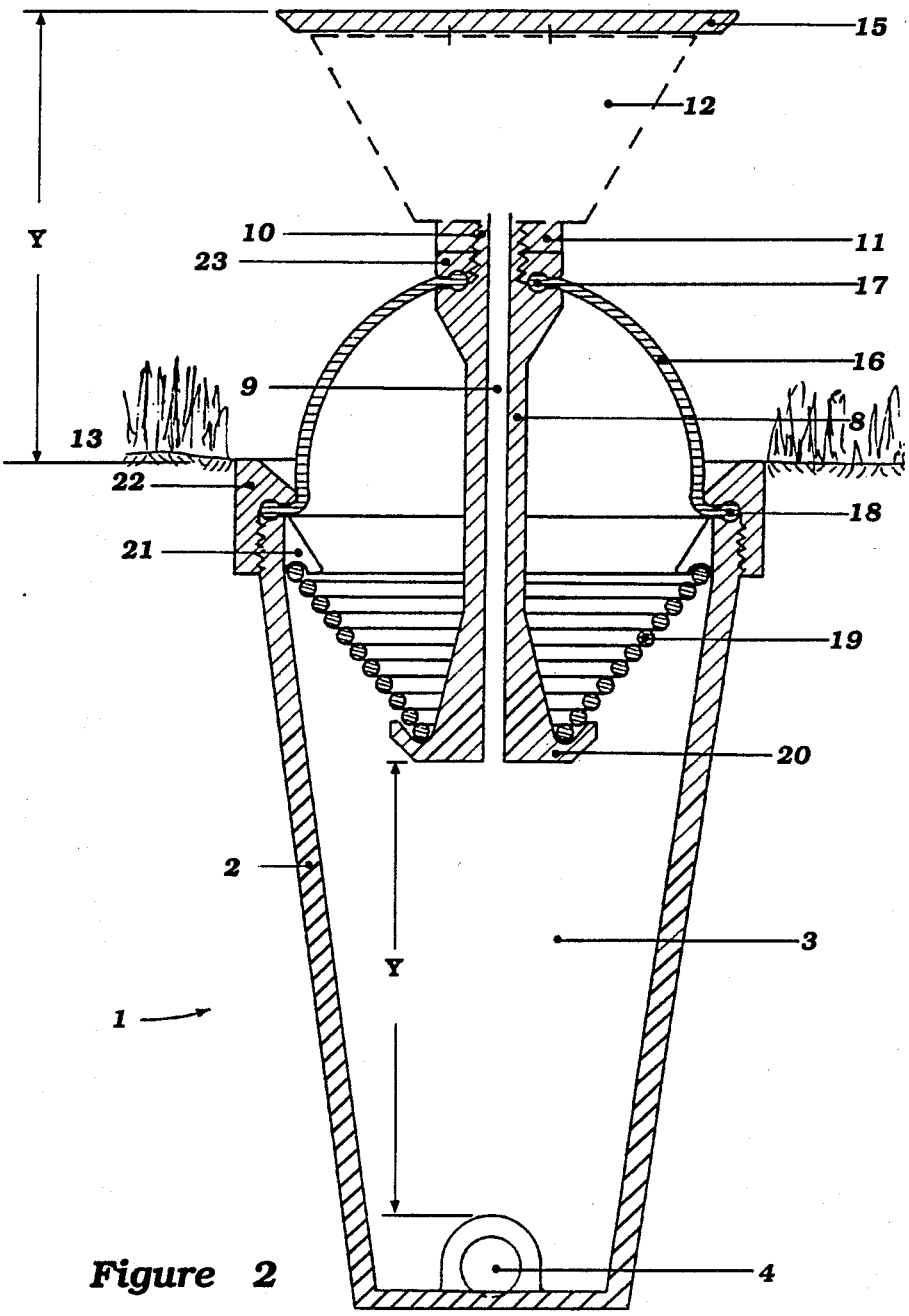
FIG. 2 is a cross-sectional side elevational view of the sprinkler of FIG. 1, but in the extended position.

Within the internal chamber 3, is provided a riser 8, which is longitudinally movable out of said internal chamber 3 to the "elevated position" as shown in FIG. 2. The position of the riser tube as shown in FIG. 1 is described herein as the "retracted position". The riser 8 is preferably constructed of moulded plastics or metal material, and is provided with a fluid passage 9 extending axially therethrough. Any suitable materials may however be utilized, such as the conventionally used metals with rubber-coating which are often found on the lids of large pop-up risers.

The upper end of the riser tube 8 is provided with a connecting neck 10, to which a collar 11 of a sprinkler head or other attachment 12 may be sealingly connected. The connecting neck 10 of the riser 8 and the collar 11 and 23 of the sprinkler head 12 are preferably connected by means of a watertight screw thread connection.

The sprinkler head 12 is provided with a suitable attachment means 14 for attachment to a lid 15, said lid 15 being provided to prevent soil and other materials, such as fertilizer, insect and weed control materials or the like, from becoming lodged within the housing 2 or the sprinkler head 12 of the irrigation sprinkler 1, to consequently inhibit the movement of the various components of the system. In the retracted position of the riser, the sprinkler head or other attachment 12 is retained fully within the confines of the housing 2 such that the lid 15 preferably lies adjacent to or slightly below the ground level surface 13.

The riser tube 8 is sealingly connected at the upper end thereof to the upper end of said housing 2 by means of a flexible diaphragm 16, thus providing a watertight connection between the riser tube 8 and the housing 2. Preferably, the flexible diaphragm 16 is of annular construction, moulded in the shape of a frustum of a cone of rubber or other flexible and elastic material, and is provided with integrally moulded flanges 17 and 18 at the inner and outer circumferences thereof respectively, for sealing attachment to the riser tube 8 and the housing 2 respectively.

The flanges 17 and 18 of the diaphragm 16 are shown connected to correspondingly shaped grooves created in the riser 8 and the housing 2, respectively. The groove provided at the upper end of the riser 8 is formed by the connection of a collar 23 with the upper end of the riser 8. Similarly, the groove provided at the upper end of the housing 2 is formed by the connection of the housing 2 with a collar 22, which is sealingly connected by means of a screw thread or the like. The diaphragm may however be connected to the housing and the riser by any suitable means, such that any suitable retaining means provided on each end of said diaphragm may be connected by collars or the like to said housing and said riser.

A spring 19 is also attached between the riser 8 and the housing 2. FIG. 1 shows the lower end of the riser 8 being provided with an outwardly extending lip 20 which supports the lower end of said spring 19, and the upper end of the housing 2 is provided with a similar inwardly extending lip 21 which engages the upper end of said spring 19. The spring 19 tends to supply an expansive force between the lip 20 of the riser 8 and the lip 21 of the housing 2, such that the riser 8 is normally maintained within the housing 2 in the retracted position.

The irrigation sprinkler 1 of the present invention provides for extremely easy assembly and/or replacement of the various components of the system. The riser 8 is firstly placed within the housing 2, and the spring 19 is connected between the lip 20 and the lip 21. The lower end of the annular diaphragm 16 is then placed into position and secured, by placing the collar 23 over the neck 10 such that a groove is formed between said collar 23 and said riser 8, into which the flange 17 of the diaphragm 16 is positioned to provide a watertight connection. The flange 18 of the annular diaphragm 16 is similarly fitted into a groove formed by the collar 22 being screw-fitted or otherwise attached onto the top of said housing 2. The sprinkler head or other attachment 12 may then be placed into position by a screw-action, connecting the neck 10 to an attaching means 11 provided on the underside of the sprinkler head 12. A lid 15, preferably freely rotating, may then be secured to the sprinkler head 12 by a suitable connection 14 provided therebetween. This method of assembly of the sprinkler system of the present invention is detailed further with reference to FIG. 3, described hereinafter.

In FIG. 2, is shown the sprinkler 1 in the raised position, wherein the riser 8 has been axially raised, and the fluid consequently flows through the riser tube 9 and is dissipated from the sprinkler head 12. In use, fluid enters the internal chamber 3 via either the fluid inlet 4 or 5 (see FIG. 1). When the fluid fills the chamber 3 (in the position shown in FIG. 1) the fluid pressure increases, forcing the diaphragm 16 to become deformed. When the fluid pressure has increased to a sufficient extent such that the restraining force of the spring 19 is overcome, the diaphragm 16 becomes reformed and the spring 19 becomes compressed to a position as shown in FIG. 2, wherein the riser 8 has been axially raised out of the housing 2. The top of the sprinkler head 12 is consequently raised to an elevation Y above ground level 13, suitable for operation of the sprinkler 1. With the sprinkler in this position, the fluid then dissipates through the sprinkler head 12.

When the fluid supply is impeded, the fluid pressure in the chamber 3 consequently decreases as the fluid continues to dissipate through the sprinkler head 12. As the fluid pressure decreases, the spring 19 expands, and the riser 8 is withdrawn into the housing 2, returning the sprinkler 1 to the retracted position as shown in FIG. 1. The force of the spring 19 retains the riser 8 and the sprinkler head 12 within the confines of the housing 2 and the ground surface 13.

Figure 3:
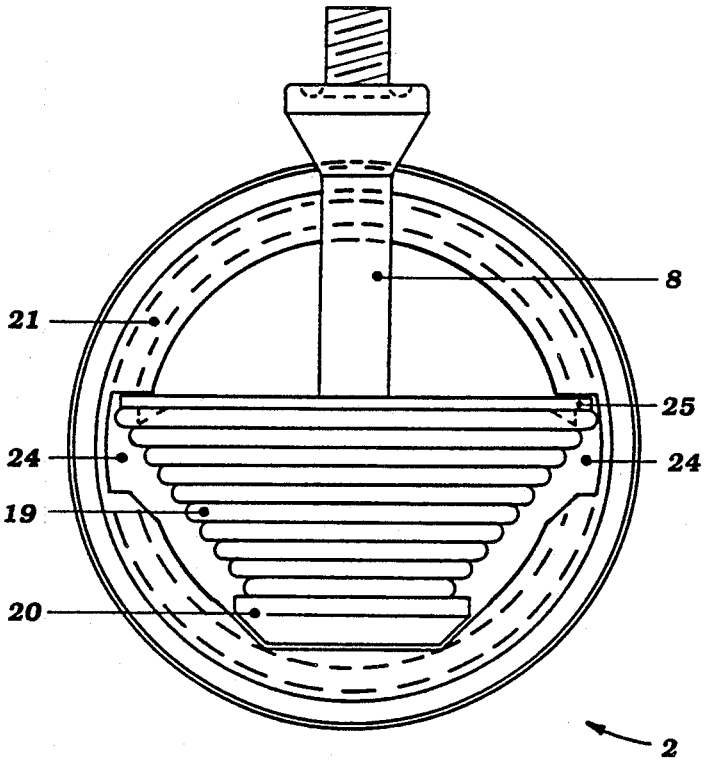
FIG. 3 details a plan view of the housing 2 of FIGS. 1 and 2, showing the method of insertion/removal of the riser and spring into/from the housing of the sprinkler unit.
Figure 4:
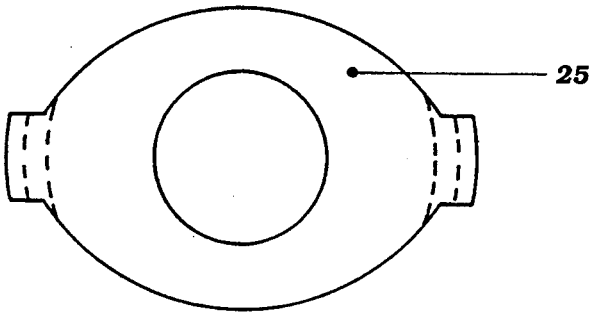
FIG. 4 is a plan view of a tool which may be used to hole the spring in a compressed state on the riser for installation in and removal from the housing.

In FIG. 3, is shown a plan view of the housing 2, showing the lip 21 provided at the top of the housing 2 and inwardly extending therefrom, such as to engage with the upper end of the spring 19. As can be seen from FIG. 3, the lip 21 is provided with two cutouts 24, such that the compressed spring 19 may be placed sideways and inserted into the housing 2 with the aid of the tool 25 which may be used to hold the spring in a compressed state on the riser 8 for installation in and removal from the housing 2.

It is thus shown that the present invention provides a sprinkler which overcomes all the disadvantages of prior art sprinklers. Not only is the sprinkler system of the present invention easy and inexpensive to manufacture, and easy to assemble, but the sprinkler of the present invention provides functional advantages during its operation over prior art sprinklers. The sprinkler system of the present invention is able to operate without the high jamming rate and maintenance problems of the prior art, and provide a durable sprinkler which is of neat and compact construction.

It should be understood that the numerous variations and modifications can be made to the sprinkler system without departing from the overall spirit and scope of the invention as described herein.

I claim:

1. A retractable sprinkler comprising a housing defining an internal cavity provided with a fluid inlet for admittng fluid to said internal cavity, a riser positioned within said cavity and spaced inwardly from said housing and defining a passage therethrough and terminating in a nozzle at an upper end thereof, a flexible diaphragm sealingly connected between an upper end of said housing and said riser contiguous to said nozzle and supporting the upper end of said riser, a coil compression spring engaged between an outwardly extending lip provided at a lower end of said riser and an inwardly extending lip integrally formed at an upper end of said housing and supporting said lower end, the outer housing being configured with an integrally formed wall at the upper end, said wall forming an opening means sized and shaped to pass said riser with said coil spring attached when said coil spring is compressed and said riser and said compressed coil spring are inserted in a generally horizontally extending position through said opening means into the cavity for rotation within said housing cavity into a generally vertically extending operative position, when rotated into a generally vertically extending position and released, said coil spring engages the underside of said upper wall for maintaining said riser in a retracted position within said housing and, upon the introduction of fluid through said fluid inlet, said coil spring yields to permit said riser to move outwardly of said housing against the compressive action of said coil spring for flow of fluid through said passage for dissipation from said nozzle.

2. A retractable sprinkler as claimed in claim 1 wherein the opening means is defined by the outer housing having opening to receive the compressed spring.

* * * * *

UNITED STATES PATENT AND TRADEMARK OFFICE

CERTIFICATE OF CORRECTION

PATENT NO. : 4,919,332

DATED : April 24, 1990

INVENTOR(S) : James L. Bailey

It is certified that error appears in the above-identified patent and that said Letters Patent is hereby corrected as shown below:

Column 6, line 13, Claim 1, "admittng" should be --admitting--.

Column 6, line 44, Claim 2, after "having" insert --an inwardly extending flange defining a slotted--.

Signed and Sealed this

Twenty-second Day of December, 1992

*Attest:*

DOUGLAS B. COMER

*Attesting Officer*

*Acting Commissioner of Patents and Trademarks*